US011505966B2

(12) United States Patent
Crosser

(10) Patent No.: US 11,505,966 B2
(45) Date of Patent: Nov. 22, 2022

(54) LOCKING DEVICE TO SECURE A DOOR AND METHODS FOR INSTALLING AND OPERATING THE LOCKING DEVICE

(71) Applicant: James Edward Crosser, Paris, TN (US)

(72) Inventor: James Edward Crosser, Paris, TN (US)

( * ) Notice: Subject to any disclaimer, the term of this patent is extended or adjusted under 35 U.S.C. 154(b) by 384 days.

(21) Appl. No.: 16/261,466

(22) Filed: Jan. 29, 2019

(65) Prior Publication Data

US 2020/0240176 A1 Jul. 30, 2020

(51) Int. Cl.
*E05B 59/00* (2006.01)
*E05C 3/16* (2006.01)
(Continued)

(52) U.S. Cl.
CPC ..... *E05B 59/00* (2013.01); *E05B 7/00* (2013.01); *E05B 15/0093* (2013.01);
(Continued)

(58) Field of Classification Search
CPC ..... E05B 7/00; E05B 15/0093; E05B 15/02; E05B 15/10; E05B 57/00; E05B 59/00;
(Continued)

(56) References Cited

U.S. PATENT DOCUMENTS 388,229 A 8/1888 Thode
655,199 A 8/1900 Collins
(Continued)

FOREIGN PATENT DOCUMENTS

CH 168068 A 3/1934
DE 1024841 B 2/1958
(Continued)

OTHER PUBLICATIONS https://www.cnn.com/videos/US/2018/02/20/teen-invents-device-to-will-save-lives-during-shootings-orig-tc.cnn—CNN Video report on JustinKase door device (last accessed Feb. 27, 2020).

*Primary Examiner* — Christopher J Boswell
(74) *Attorney, Agent, or Firm* — Butler Snow LLP

(57) ABSTRACT

A device for securing a door including a rotatable handle affixed to the door, a rotatable member affixed to the door, a catch, and a protrusion from the rotatable handle that is configured to lift the member when the member is engaged with the catch and the rotatable handle is rotated.

A device for securing a door including a member configured to be rotatably attached to the door, a catch configured to be attached to a wall adjacent to the door and to receive the member, and a protrusion configured to be attached to a handle on the door and to lift the member when the member is in a closed position and the handle is rotated.

A method for installing a device for securing a door with a handle, the method including affixing a member to the door so that the member can rotate, affixing a catch to a wall adjacent the door, the catch configured to receive the member, and affixing a protrusion to the handle, the protrusion configured to lift the member when the member is engaged with the catch and the handle is rotated.

19 Claims, 5 Drawing Sheets

(51) Int. Cl.

| | |
|---|---|
| ***E05B 57/00*** | (2006.01) |
| ***E05B 7/00*** | (2006.01) |
| ***E05B 63/00*** | (2006.01) |
| ***E05B 15/02*** | (2006.01) |
| ***E05B 63/12*** | (2006.01) |
| ***E05C 9/18*** | (2006.01) |
| ***E05C 19/00*** | (2006.01) |
| ***E05B 15/00*** | (2006.01) |
| ***E05B 65/52*** | (2006.01) |

(52) U.S. Cl.
CPC ..... *E05B 15/02* (2013.01); *E05B 57/00* (2013.01); *E05B 63/00* (2013.01); *E05B 63/12* (2013.01); *E05B 65/5253* (2013.01); *E05C 3/167* (2013.01); *E05C 9/1808* (2013.01); *E05C 19/005* (2013.01)

(58) Field of Classification Search
CPC ..... E05B 63/00; E05B 63/12; E05B 63/14; E05B 65/0032; E05B 65/48; E05B 65/5246; E05B 65/5253; E05B 65/5284; E05C 9/18; E05C 9/1808; E05C 19/003; E05C 19/005; E05C 19/08; E05C 19/10; E05C 19/12
See application file for complete search history.

(56) References Cited

U.S. PATENT DOCUMENTS

| | | | | |
|---|---|---|---|---|
| 953,086 | A | 6/1910 | Haupt | |
| 1,533,257 | A | 4/1925 | McKinney | |
| 1,700,093 | A | 1/1929 | Hamm | |
| 1,704,730 | A | 3/1929 | Dickey | |
| 1,763,692 | A * | 6/1930 | Ferris | E05C 3/167 292/236 |
| 1,782,845 | A | 11/1930 | Fildes | |
| 1,861,252 | A | 5/1932 | Whitcomb | |
| 1,919,328 | A | 7/1933 | Hansen | |
| 2,274,259 | A * | 2/1942 | Russo | E05B 57/00 292/231 |
| 2,523,845 | A * | 9/1950 | Roseburrough | E05C 19/10 292/108 |
| 2,644,708 | A * | 7/1953 | Poole | E05C 3/167 292/236 |
| 3,341,241 | A | 9/1967 | Carlson et al. | |
| 3,971,238 | A * | 7/1976 | Walker | E05C 17/166 70/135 |
| 4,062,575 | A | 12/1977 | Robins | |
| 4,606,566 | A * | 8/1986 | Bott | E05C 19/003 292/57 |
| 5,529,352 | A * | 6/1996 | Chin | E05C 3/041 292/230 |
| 5,704,662 | A | 1/1998 | Kwiatkowski | |
| 5,741,033 | A | 4/1998 | Everett | |
| 6,176,041 | B1 | 1/2001 | Roberts | |
| 6,655,178 | B1 * | 12/2003 | Lingbeck | E05B 17/2088 292/DIG. 41 |
| 7,412,855 | B2 * | 8/2008 | Dolev | E05B 9/08 70/11 |
| 8,167,386 | B2 | 5/2012 | Bergesch et al. | |
| 10,006,231 | B2 * | 6/2018 | Grommet | E05B 17/2034 |
| 2002/0157319 | A1 | 10/2002 | Haq | |
| 2008/0022728 | A1 | 1/2008 | Flory | |
| 2009/0120004 | A1 | 5/2009 | Cobb | |
| 2010/0313382 | A1 | 12/2010 | Andren | |
| 2012/0267903 | A1 | 10/2012 | Welsby et al. | |
| 2013/0105502 | A1 | 5/2013 | Naunheimer et al. | |
| 2015/0376920 | A1 | 12/2015 | Subliskey et al. | |

FOREIGN PATENT DOCUMENTS

| | | | |
|---|---|---|---|
| FR | 319495 | A | 11/1902 |
| FR | 345721 | A | 12/1904 |
| FR | 2553461 | A1 | 4/1985 |

* cited by examiner

LOCKING DEVICE TO SECURE A DOOR AND METHODS FOR INSTALLING AND OPERATING THE LOCKING DEVICE

FIELD OF THE INVENTION

The invention relates to a locking device for securing a door and methods of installing and operating the locking device.

BACKGROUND OF THE INVENTION

Doors have long been used to define entrances to certain areas or enclosed spaces. Various mechanisms can be used in conjunction with doors to restrict access to these areas and spaces. For example, doors have long been fitted with keylocks and bolt locks to prevent unauthorized persons from accessing a particular area or space.

Known locking mechanisms for doors are cumbersome to operate and often create a safety hazard, because they impede the quick movement of persons into and out of a space or room. This is especially true in environments like schools, hospitals, churches and the like. In fact, there are laws and codes that often prohibit the use of many of today's locking mechanisms on certain doors. For example, local fire codes may prohibit the use of certain locks on some doors, because the locks may impede the flow of people trying to escape an emergency, such as a fire.

Not only are many of today's locking mechanisms cumbersome to unlock, but they are cumbersome to lock, which also creates a safety hazard. A delay in activating a locking mechanism for a door may allow unauthorized persons to access an area or space. For example, a delay in activating a locking mechanism in an active shooter situation may allow the shooter to easily enter areas or spaces where many targets are present. For these reasons, there is a need for a locking mechanism for a door that can be quickly and easily activated and deactivated.

SUMMARY OF THE INVENTION

In various exemplary embodiments, the device for securing a door comprises a rotatable handle affixed to a door, a rotatable member affixed to the door, a catch, and a protrusion from the rotatable handle that is configured to lift the member when the member is engaged with the catch and the rotatable handle is rotated.

In various exemplary embodiments, the device for securing a door comprises a member configured to be rotatably attached to a door, a catch configured to be attached to a wall adjacent to the door and to receive the member, and a protrusion configured to be attached to a handle on the door and to lift the member when the member is in a closed position and the handle is rotated.

In various exemplary embodiments, the method for installing a device for securing a door with a handle comprises affixing a member to a door so that the member can rotate, affixing a catch to a wall adjacent the door, the catch configured to receive the member, and affixing a protrusion to the handle, the protrusion configured to lift the member when the member is engaged with the catch and the handle is rotated.

DETAILED DESCRIPTION

Figure 1:
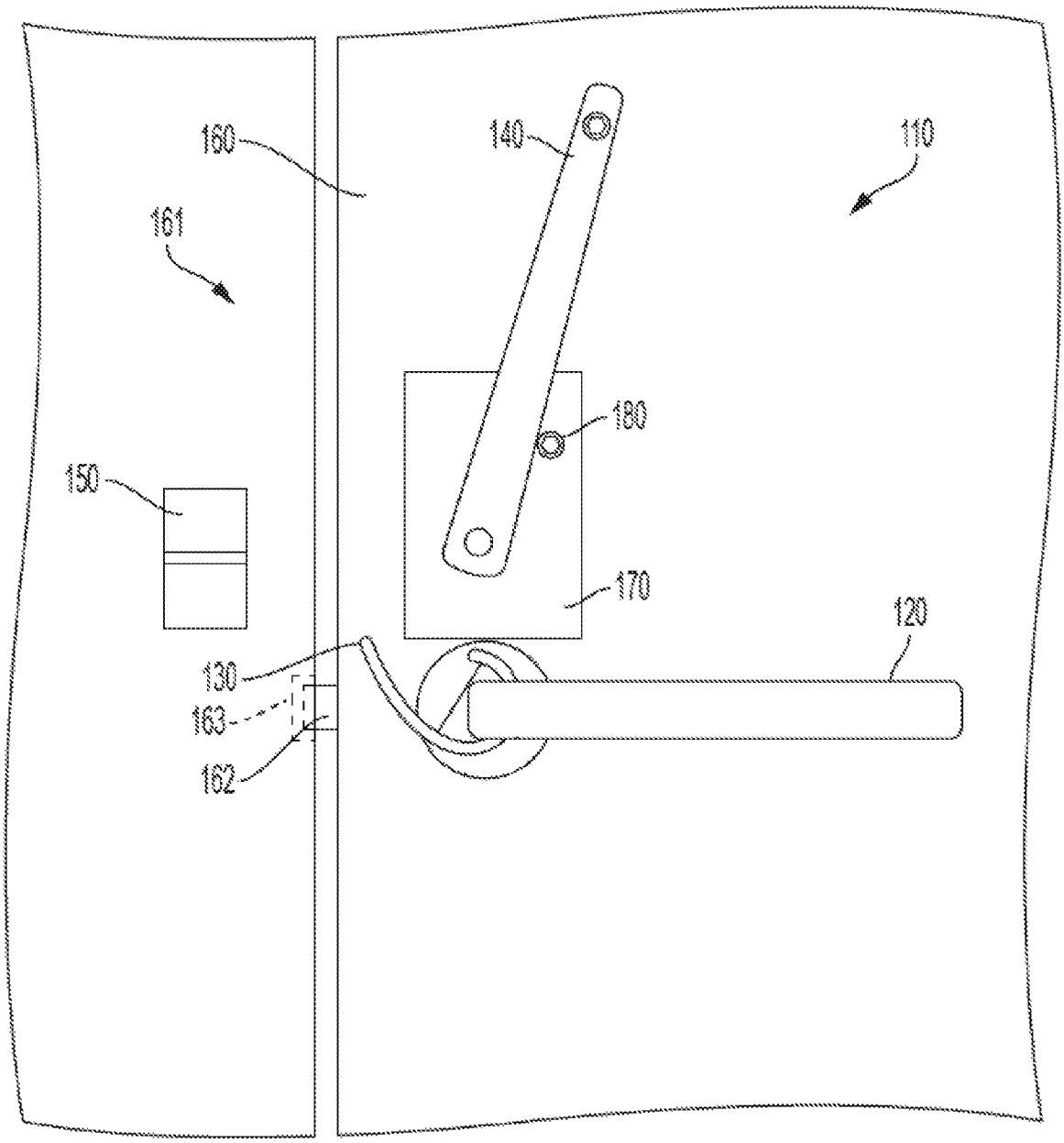
FIG. 1 shows a first front view of a first embodiment of the invention.

FIG. 1 shows a first front view of a first embodiment of door lock 110 of the present invention. In this embodiment, door lock 110 is used with a common door 160. The door 160 includes a tab 162 that engages with a cavity 163 in wall 161 to prevent door 160 from opening. Rotating handle 120 retracts tab 162 so that tab 162 is no longer engaged with cavity 163, allowing a user to open door 160. In this figure, door 160 swings inward to open.

In this embodiment, handle 120 is elongated. Affixed to handle 120 is protrusion 130. Door lock 110 also includes bar 140 and catch 150. Bar 140 is movably connected to door 160, and catch 150 is affixed to wall 161. In this embodiment, bar 140 is connected to door 160 through mounting plate 170. Mounting plate 170 includes stop 180. In alternative embodiments, bar 140 is movably connected to door 160 without the use of mounting plate 170 and/or through additional components. As discussed further below, the use of mounting plate 170 allows door lock 110 to be more easily installed on a range of existing doors 160. In additional alternative embodiments, protrusion 130 need not be affixed to handle 120 but may be a design feature of handle 120 itself.

In FIG. 1, bar 140 is in an open position and does not engage catch 150 to prevent door 160 from opening. Stop 180 is affixed to door 160 and limits bar 140's range of movement. In this embodiment, stop 180 is positioned to hold bar 140 in an open position until a user moves bar 140 to a closed position with his hand. Stop 180 also prevents bar 140 from moving clockwise and interfering with operation of handle 120. In this embodiment, stop 180 is located so as to minimize the possibility that bar 140 will fall into the closed position unintentionally when door 160 is opened and closed, but also so as to allow a user of door lock 110 to quickly move bar 140 into the closed position with the user's hand.

Protrusion 130 moves with handle 120 but does not engage bar 140 when bar 140 is in the open position. When bar 140 is in an open position a user standing on the near side of door 160 can turn handle 120 and pull door 160 open. When bar 140 is in an open position a user standing on the near side of door 160 can push door 160 shut. When bar 140 is in an open position a user standing on the far side of door 160 can turn a handle on the far side of door 160 and push door 160 open. When bar 140 is in an open position a user standing on the far side of door 160 can pull door 160 shut.

Figure 2:
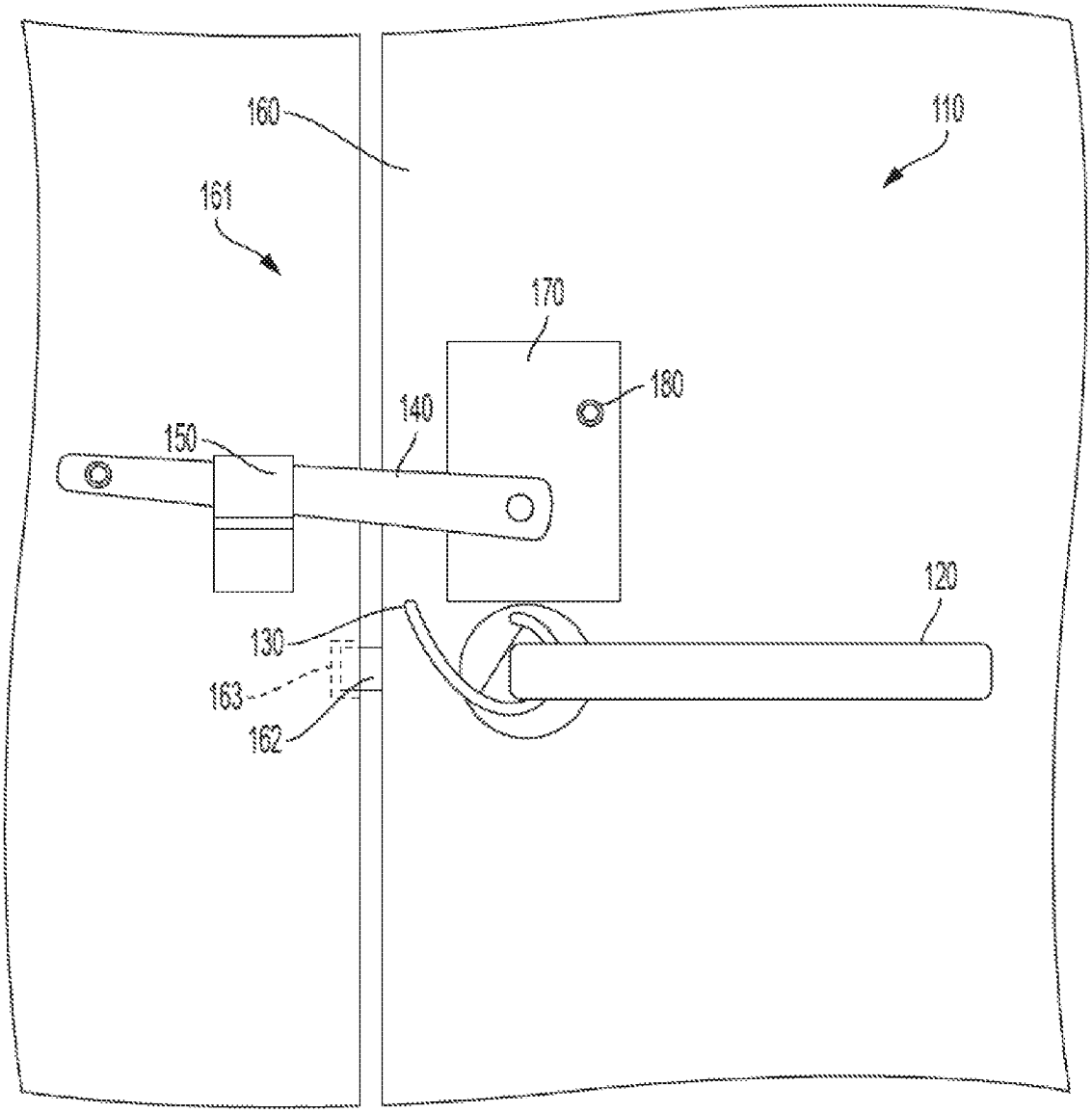
FIG. 2 shows a second front view of the first embodiment of the invention.

FIG. 2 shows a second front view of the first embodiment of door lock 110. In this view, bar 140 is in the closed position. The user generally moves bar 140 into a closed position by using his hand to rotate bar 140 so that it engages catch 150. In the closed position, bar 140 is engaged with catch 150 to prevent door 160 from opening. A user standing on the near side of door 160 can open door 160 by turning handle 120 and pulling door 160 open. Turning handle 120 disengages tab 162 and cavity 163 and also rotates protrusion 130 to engage bar 140, lifting bar 140 upward. The disengagement of tab 162 and cavity 163 and engagement of protrusion 130 and bar 140 allows the user to pull door 160 open. In this embodiment, the rotation of handle 120 turns bar 140 so that it contacts stop 180 and remains in the open position. The user on the near side of door 160 need only make a single motion to open door 160 when bar 140 is in the closed position. In alternative embodiments, turning handle 120 may raise bar 140 such that bar 140 does not prevent door 160 from opening, but not to the extent that bar 140 contacts stop 180. In those embodiments, bar 140 will return to the closed position until a user places bar 140 in the open position. In still alternative embodiments, mounting plate 170 may include a second stop that limits the downward movement of bar 140 so that bar 140 remains in a closed position and engaged with catch 150. In these embodiment, catch 150 does not limit the downward motion of bar 140 but only prevents the door from being opened and closed when bar 140 is in the closed position.

In the first embodiment, a user standing on the far side of door 160 is generally unable to open door 160 when bar 140 is in the closed position. While the user on the far side of door 160 may be able to rotate a handle on the far side of door 160 to disengage tab 162 and cavity 163, such rotation will not rotate handle 120 to engage protrusion 130 and bar 140, and bar 140 will remain in the closed position. As an optional feature for this embodiment, bar 140 of door lock 110 may be made of a magnetic material so that a user on the far side of door 160 can raise bar 140 and open door 160 with a magnet. As an alternative feature, a key hole is installed through door 160 and mounting plate 170 that allows a user on the far side of door 160 to use a key to lift bar 140 upward so that bar 140 does not prevent door 160 from opening. The rotation of the key may lift bar 140 directly or through a lever or other device.

In alternative embodiments, door 160 swings outward to open. In these embodiments, the door lock works in the same manner as the door lock of the first embodiment, except that bar 140 and catch 150 prevent the door 160 from opening outward when bar 140 is in the closed position. As with the door lock of the first embodiment, while a user on the near side of door 160 can open door 160 by rotating handle 120, a user on the far side of door 160 will not be able to open door 160 by rotating a handle on the far side of door 160 when bar 140 is in the closed position.

Figure 3:
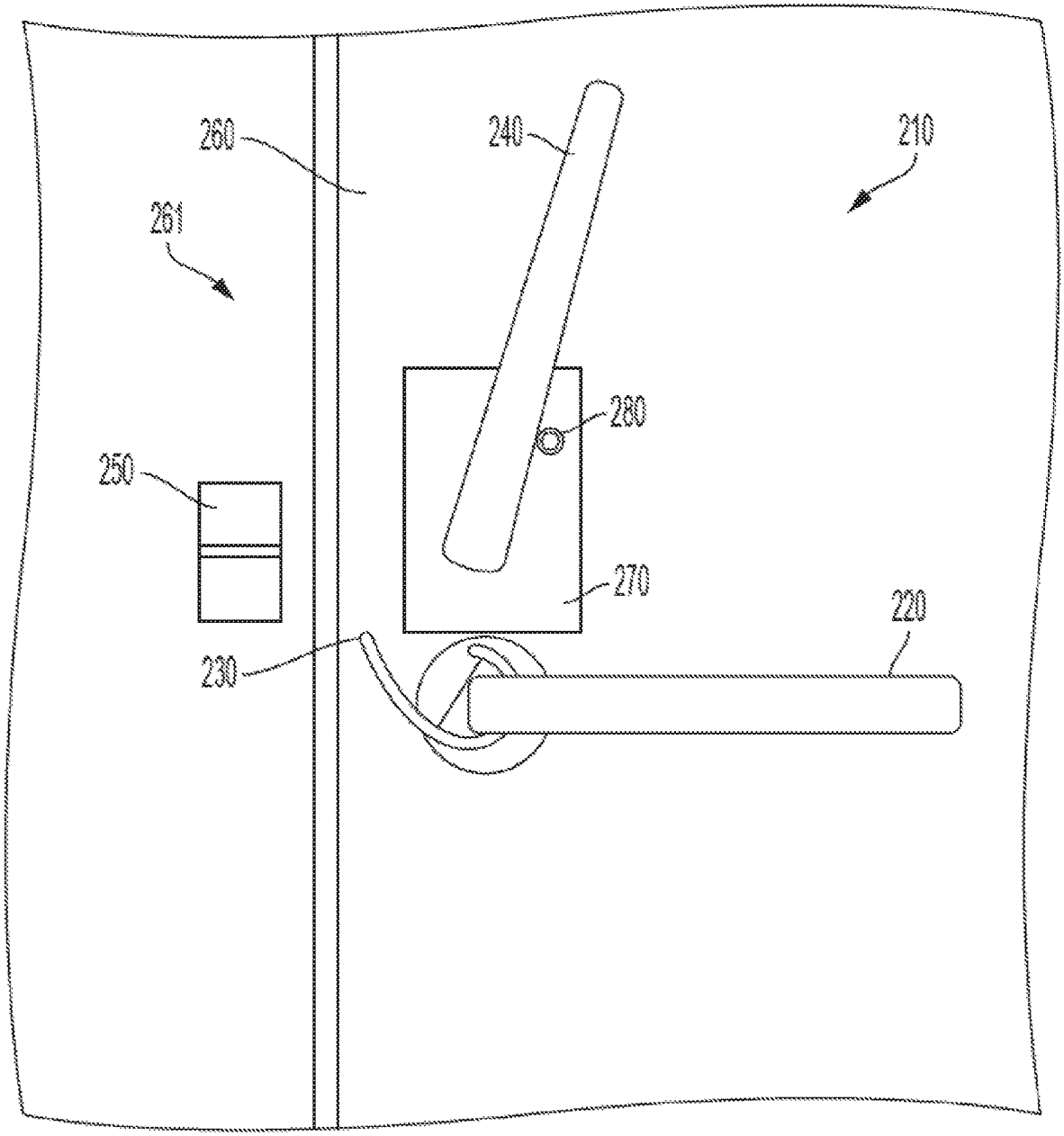
FIG. 3 shows a front view of a second embodiment of the invention.

FIG. 3 shows a first front view of a second embodiment of a door lock 210 of the present invention. The components of the door lock 210 are substantially the same as the components of door lock 110, except that it is used on a door that does not have tab 162 and cavity 163. In this figure, door 260 swings inward to open.

Door lock 210 includes a handle 220, which is movably connected to door 260. A protrusion 230 is affixed to handle 220. Door lock 210 also includes a bar 240 and catch 250. Bar 240 is movably connected to door 260, and catch 250 is affixed to wall 261. In this embodiment, bar 240 is connected to door 260 through mounting plate 270. Mounting plate 270 includes stop 280.

When bar 240 is in an open position a user standing on the near side of door 260 can pull door 260 open. When bar 240 is in an open position a user standing on the near side of door 260 can push door 260 shut. When bar 240 is in an open position a user standing on the far side of door 260 can push door 260 open. When bar 240 is in an open position a user standing on the far side of door 260 can pull door 260 shut.

In the closed position, bar 240 is engaged with catch 250 to prevent door 260 from opening. A user standing on the near side of door 260 can open door 260 by turning handle 220 and pulling door 260 open. Turning handle 220 rotates protrusion 230 so that it engages bar 240 and lifts bar 240 upward. Rotating handle 220 engages protrusion 230 and bar 240 and allows the user to pull door 260 open. A user standing on the far side of door 260 is generally unable to open door 260 when bar 240 is in the closed position. While the user on the far side of door 260 may be able to push on door 260, they are not able to rotate handle 220 to engage protrusion 230 and bar 240, and bar 240 will remain in the closed position. In alternative embodiment, door 260 may include a spring or other device that biases door 260 closed. In still further embodiments, mounting plate 270 may include a second stop that limits the downward movement of bar 240 to bar 240's closed position. In further embodiments, catch 250 may be shaped so that if door 260 is closed while bar 240 is in the closed position, catch 250 will lift bar 240 and bar 240 will fall into the closed position when door 260 is completely closed. In these embodiments, bar 240 may engage with catch 250 to prevent door 260 from opening when door 260 is closed by a user.

Figure 4:
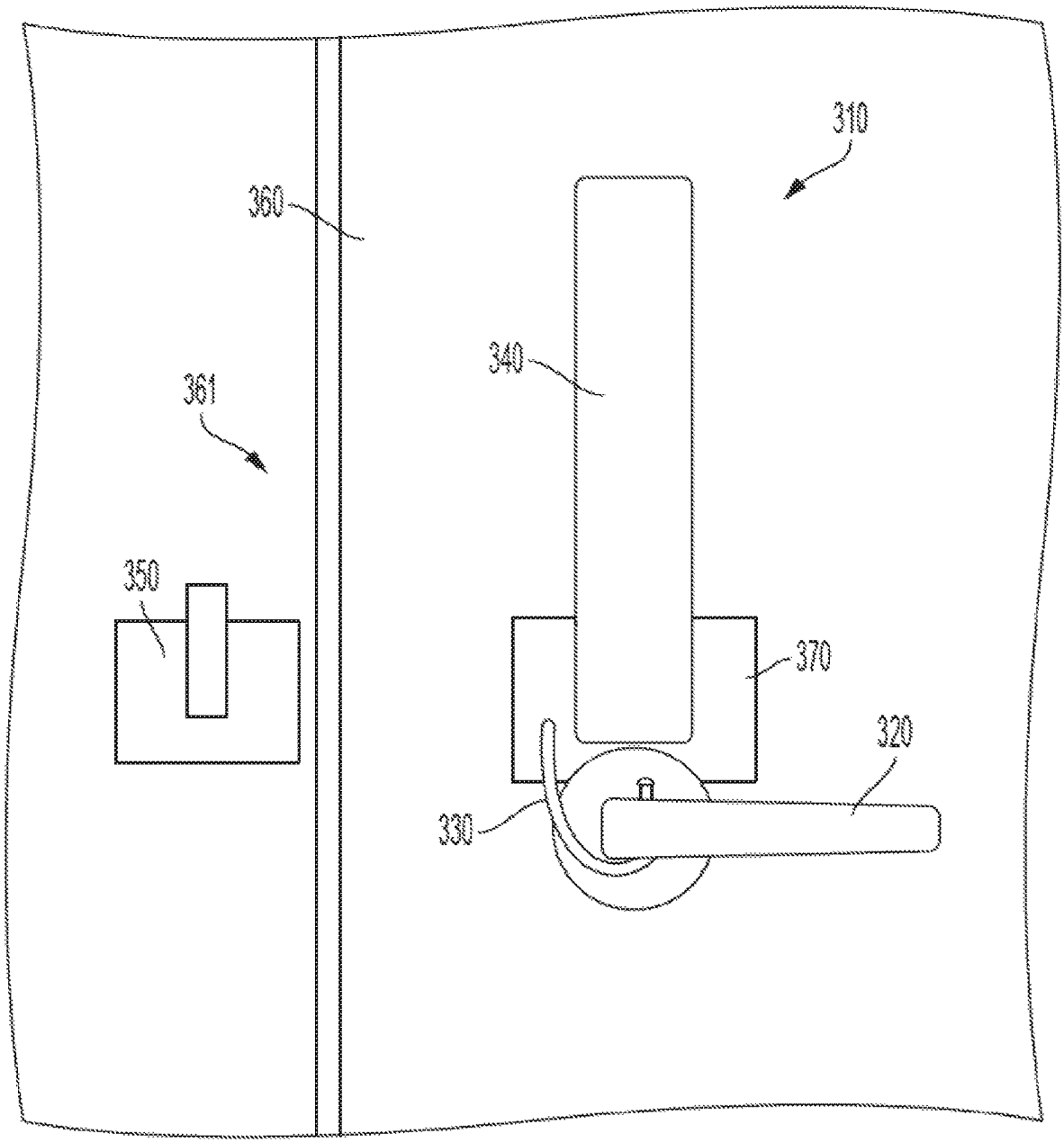
FIG. 4 shows a front view of a third embodiment of the invention.

FIG. 4 shows a front view of a third embodiment of door lock 310. In this embodiment, mounting block 370 does not include a stop. Further, in this embodiment, catch 350 comprises a simply U-shaped element. The remainder of the components of door lock 310 are the same as the components of the door lock 210. Door lock 310 includes bar 340 that is rotatably affixed to door 360 via mounting block 370. Bar 340 is configured to engage catch 350 on wall 361. Protrusion 330 is affixed to handle 320.

Figure 5:
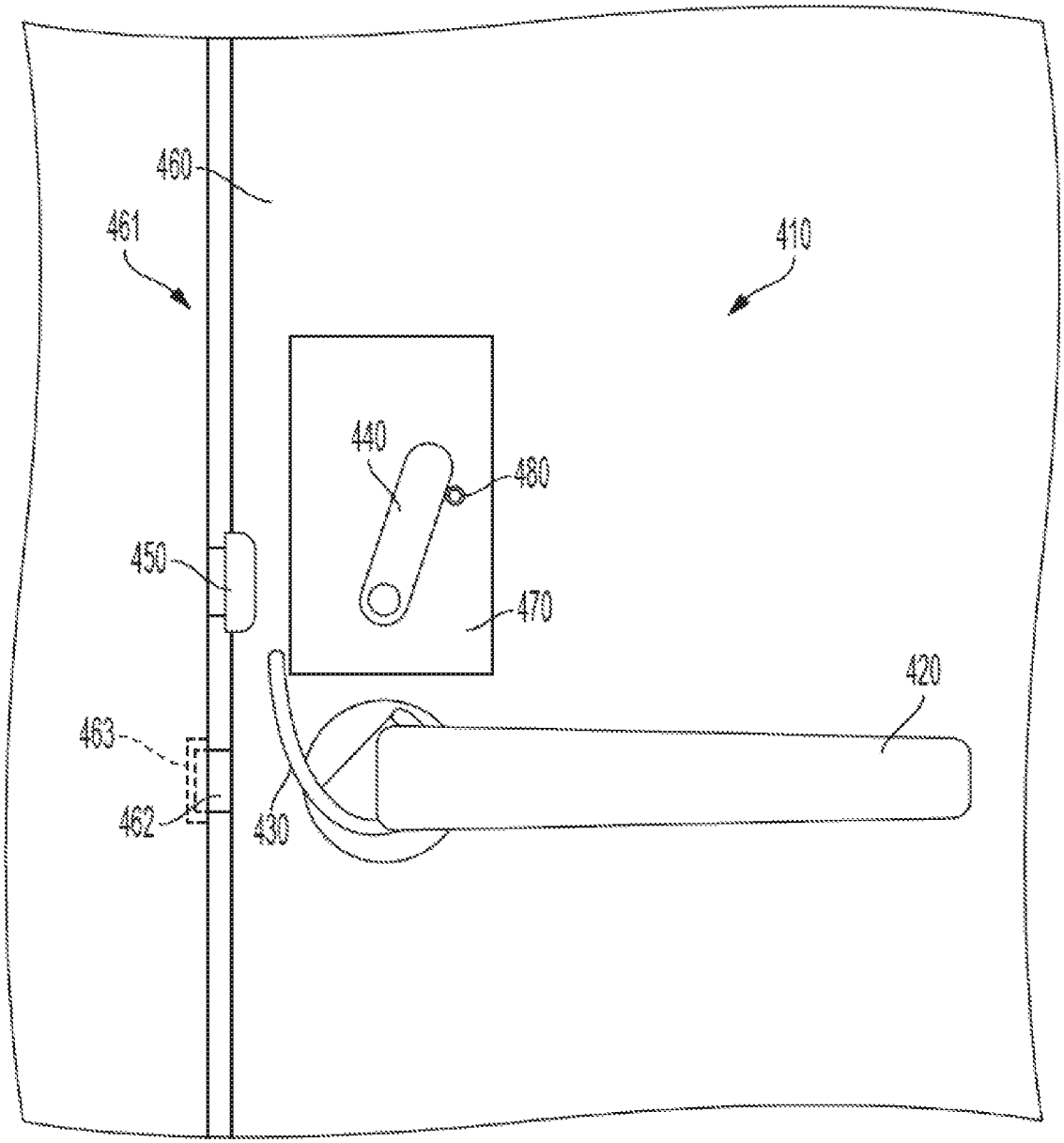
FIG. 5 shows a front view of a fourth embodiment of the invention.

FIG. 5 shows a front view of a fourth embodiment of door lock 410. In this embodiment, door lock 410 is used with a standard door 460. The door 460 includes tab 462 that engages with cavity 463 in wall 461 to prevent door 460 from opening. Door 460 can be opened by rotating handle 420 so that tab 462 is no longer engaged with cavity 463 and door 460 can be pushed open. In this figure, door 460 swings outward to open.

The components of door lock 410 are substantially the same as the components of door lock 410, except that bar 440 and catch 450 are modified. In this embodiment, catch 450 is affixed to wall 461 but extends toward door 460. Bar 440 has been shortened. Bar 440 is attached to door 460 through mounting plate 470.

In FIG. 5, bar 440 is in an open position and does not engage catch 450 to prevent door 460 from opening. Protrusion 430 moves with handle 420 but does not engage bar 440 when bar 440 is in the open position. When bar 440 is in an open position a user standing on the near side of door 460 can turn handle 420 and push door 460 open. When bar 440 is in an open position a user standing on the near side of door 460 can pull door 460 shut. When bar 440 is in an open position a user standing on the far side of door 460 can turn a handle on the far side of door 460 and pull door 460 open. When bar 440 is in an open position a user standing on the far side of door 460 can push door 460 shut.

In the closed position, bar 440 is engaged with catch 450 to prevent door 460 from opening. A user standing on the near side of door 460 can open door 460 by turning handle 420 and pushing door 460 open. Turning handle 420 disengages tab 462 and cavity 463 and also rotates protrusion 430 to engage bar 440, lifting bar 440 upward. The disengagement of tab 462 and cavity 463 and engagement of protrusion 430 and bar 440 allows the user to push door 460 open. In this embodiment, the rotation of handle 420 engages protrusion 430 and bar 440 so that bar 440 contacts stop 480 and remains in the open position. The user on the near side of door 460 need only make a single motion to open door 460 when bar 440 is in the closed position.

In this embodiment, a user standing on the far side of door 460 is generally unable to open door 460 when bar 440 is in the closed position. While the user on the far side of door 460 may be able to rotate a handle on the far side of door 460 to disengage tab 462 and cavity 463, such rotation will not rotate handle 420 to engage protrusion 430 and bar 440, and bar 440 will remain in the closed position In some embodiments of the invention, the door may include a lock that can be used to further limit who can open and close door 460. Additional embodiments may include a handle and protrusion as a unitary piece. Still further embodiments may include handles of different shapes, such as knobs.

FIGS. 1 and 2 also depict a method of installing a door lock 110 on an existing door 160. In this embodiment, handle 120 and door 160 are pre-existing. The method includes attaching protrusion 130 to handle 120 of door 160. In this embodiment, protrusion 130 comprises an elongated element. One end of protrusion 130 is wrapped around handle 120, and the other end of protrusion 130 is configured to engage bar 140 when bar 140 is in the closed position and handle 120 is rotated. The end of protrusion 130 that is wrapped around handle 120 may be secured in place by additional components or fasteners or may attached to handle 120 through mechanical or chemical means, such as compressing protrusion 130 onto handle 120, having protrusion 130 penetrate handle 120, using a glue, or welding. In alternative embodiments, protrusion 130 need not be wrapped around handle 120 but may be affixed to handle 120 directly through any of the aforementioned means.

The method also includes attaching bar 140 to door 160. In this embodiment, bar 140 is attached to door 160 through mounting plate 170. The mounting plate 170 includes preset holes that allow the position of stop 180 to be set for different sized doors and doors that are set on either the left or right side. Catch 150 is then affixed to wall 161. The placement of the protrusion 130, mounting plate 170, bar 140 and catch 150 are set so the door can operate for its intended purpose, as described in detail above. By installing the door lock on existing doors, the door locks can be put into wide use easily and cheaply.

While the present disclosure has been presented above with respect to the described and illustrated embodiments of a door locking device and with methods for operating and installing door locking devices, it is to be understood that the disclosure is not to be limited to those alternative and described embodiments and preferred embodiments. Various modifications, which will be become apparent to one skill in the art, fall within the scope of this invention including as described in the attached claims.

The invention claimed is:

1. A door locking device, comprising:

a first rotatable handle affixed to a door;

a rotatable member affixed to the door through a mounting plate, the mounting plate including a first stop configured to hold the rotatable member in an open position a second stop that is configured to hold the rotatable member in a closed position;

a catch affixed to a wall adjacent the door; and a protrusion extending outward from the first rotatable handle, wherein the protrusion is configured to lift the member when the member is engaged with the catch and the first rotatable handle is rotated.

2. The door locking device of claim 1, further comprising:

a second rotatable handle affixed to the door, opposite the first rotatable handle, the second rotatable handle configured so that the protrusion from the first rotatable handle does not lift the member when the member is engaged with the catch and the second rotatable handle is rotated.

3. The door locking device of claim 2, further comprising:

a retractable tab on the door that is configured to engage with a cavity in the wall, the retractable tab being operable from the first rotatable handle and the second rotatable handle.

4. The door locking device of claim 3 wherein the retractable tab is configured so that, if the rotatable member is an open position, the door may be closed without rotating the first rotatable handle or the second rotatable handle but may not be opened without rotating the first rotatable handle or the second rotatable handle.

5. The door locking device of claim 1, wherein the rotatable member is substantially straight, and the first stop is configured to hold the rotatable member in an upward position extending away from the wall at more than 10 degrees but less than 80 degrees from a vertical position.

6. A door locking device comprising:

a door movable between an open position and a closed position;

a wall substantially coplanar with a surface the door when the door is in the closed position and extending along and spaced apart from at least one edge of the door;

a rotatable handle affixed to the door proximate the at least one edge;

a member rotatably coupled with the surface of the door and movable between a closed position and an open position;

a catch coupled with the wall adjacent to the door and configured to be engaged with the member in the closed position;

a protrusion coupled with and rotatable with the handle, wherein rotation of the handle and the protrusion is configured to bias the member from the closed position to the open position; and a retractable tab on the door that is configured to engage with a cavity in the wall, the retractable tab being operable from the rotatable handle.

7. The door locking device of claim 6 further comprising a door plate for attaching the member to the door.

8. The door locking device of claim 7 wherein the catch is angled on one side so that when the member is in the closed position and the door is closed the catch with lift the member.

9. The door locking device of claim 8 wherein the protrusion includes a curved portion for engaging the handle.

10. The door locking device of claim 6, wherein the retractable tab is configured so that, if the rotatable member is an open position, the door may be closed without rotating the first rotatable handle or the second rotatable handle but may not be opened without rotating the first rotatable handle or the second rotatable handle.

11. The door locking device of claim 6, wherein the rotatable member is affixed to the door through a mounting plate including a first stop configured to hold the rotatable member in the open position.

12. The door locking device of claim 11, wherein the first stop is configured to hold the rotatable member in an upward position extending away from the wall at more than 10 degrees but less than 80 degrees from a vertical position.

13. The locking device of claim 11, wherein the mounting plate includes a second stop that is configured to hold the rotatable member in the closed position.

14. The locking device of claim 6, wherein the member is substantially straight and extends parallel to the surface of the door in both the open position and the closed position.

15. A method for installing a locking device on a door, the method comprising:

coupling a retractable tab with said door;

coupling a handle with said door such that the handle is movable between first and second positions, wherein the handle is configured to disengage the retractable tab from the cavity when the handle is in the second position;

affixing a member to said door so that the member can rotate;

affixing a catch to a wall adjacent said door, the catch configured to selectively receive the member; and affixing a protrusion to the handle such that the protrusion extends from and is rotatable in conjunction with the handle, wherein movement of the door handle from the first position to the second position is configured to cause the protrusion to contact and lift the member out of engagement with the catch.

16. The method of claim 15, further comprising:

forming the protrusion to include a curved portion for affixing the protrusion to the handle.

17. The method of claim 15, wherein affixing the member to said door includes affixing the member to said door through a wall plate.

18. The method of claim 17 further comprising:

selecting a wall plate that includes a stop configured to hold the member in an open position.

19. The method of claim 18, further comprising:

selecting a member that is substantially straight such that the stop for holding the member in an open position is configured to hold the member in an upward position extending away from the wall at more than 10 degrees but less than 80 degrees from a vertical position.

* * * * *